US005682755A

United States Patent [19]

Uchida et al.

[11] Patent Number: 5,682,755

[45] Date of Patent: Nov. 4, 1997

[54] CONTROL METHOD AND CONTROL APPARATUS FOR ABSORPTION TYPE REFRIGERATING APPARATUS

[75] Inventors: Hideki Uchida; Masahiro Furukawa, both of Gunma-ken, Japan

[73] Assignee: Sanyo Electric Co., Ltd., Osaka-fu, Japan

[21] Appl. No.: 719,438

[22] Filed: Sep. 25, 1996

[30] Foreign Application Priority Data

Sep. 29, 1995 [JP] Japan ..... 7-253875

[51] Int. Cl.[6] ..... F25B 15/00

[52] U.S. Cl. ..... 62/148; 62/476

[58] Field of Search ..... 62/148, 141, 101, 62/476, 232

[56] References Cited

U.S. PATENT DOCUMENTS

| | | | |
|---|---|---|---|
| 4,375,750 | 3/1983 | Blomberg | 62/101 |
| 5,138,846 | 8/1992 | Ogawa et al. | 62/148 |
| 5,259,202 | 11/1993 | Nishiguchi et al. | 62/147 |

*Primary Examiner*—William Doerrler

*Attorney, Agent, or Firm*—Weingarten, Schurgin, Gagnebin & Hayes LLP

[57] ABSTRACT

A method of controlling an absorption type refrigerating apparatus comprising detecting the temperature of the regenerator, limiting the amount of heating in the regenerator for a first predetermined time after the temperature of the regenerator reaches a predetermined temperature, controlling the amount of heating in the regenerator in accordance with a load when the temperature of the regenerator after the passage of the first predetermined time is lower than the predetermined temperature, abnormally suspending the regenerator by distinguishing a normal rise in the temperature of the regenerator caused by a load fluctuation from a rise in the temperature of the regenerator caused by leakage in the apparatus or the like when the temperature of the regenerator reaches the predetermined temperature within a second predetermined time after the passage of the first predetermined time, thereby avoiding repetitions of operation, suspension or limited operation of the regenerator and suppressing the corrosion of the regenerator.

6 Claims, 6 Drawing Sheets

CONTROL METHOD AND CONTROL APPARATUS FOR ABSORPTION TYPE REFRIGERATING APPARATUS

BACKGROUND OF THE INVENTION

1. Field of the Invention

This invention relates to an absorption type refrigerating apparatus and, more specifically, to a method of controlling an absorption type refrigerating apparatus for controlling the amount of heating in a regenerator based on the temperature of the regenerator.

2. Background Art

JP-A 203282/1993 (the term "JP-A" as used herein means an "unexamined published Japanese patent application"), for example, discloses an absorption cooling and heating apparatus comprising a high-temperature regenerator protection switch for turning on and off a burner provided in a high-temperature regenerator by detecting the temperature of the high-temperature regenerator.

The temperature protection control of the high-temperature regenerator is carried out by stopping the burner based on the output of the high-temperature regenerator protection switch for detecting the temperature of the high-temperature regenerator.

In the above prior art, when the temperature of the high-temperature regenerator is equal to or higher than a predetermined value, the burner is turned off based on the output of the high-temperature regenerator protection switch and then turned on when the temperature of the high-temperature regenerator falls. Therefore, when the capability of the absorption cooling and heating apparatus is reduced by the leakage of the outside air in the apparatus or the like, there is the possibility that the high-temperature regenerator protection switch is activated frequently and the burner is turned on and off repeatedly.

When the burner is turned on and off repeatedly as described above, there arise such problems that the temperature of the high-temperature regenerator becomes higher than the temperature during normal operation and that the corrosion of the high-temperature regenerator is accelerated.

Further, there has been available a method of controlling the heating of the burner based on the temperature of the high-temperature regenerator, such as one in which forced limitation operation for forcedly reducing the amount of heating of the burner for a predetermined time is carried out when the temperature of the high-temperature regenerator rises up to a predetermined temperature and then the apparatus returns to normal control. When the degree of abnormality such as leakage into the apparatus becomes high, even with this method, there arise such a problem that forced limitation operation and normal operation are repeated as well as the same problems as described above that the temperature of the regenerator becomes higher than the temperature during normal operation and that the corrosion of the high-temperature regenerator is accelerated.

SUMMARY OF THE INVENTION

To solve the above problems, the present invention claimed in claim 1 provides a method of controlling an absorption type refrigerating apparatus for controlling the amount of heating in a regenerator in accordance with a load by forming circulation paths for a refrigerant and an absorption solution by connecting the regenerator, a condenser, an evaporator and an absorber by pipes, the method comprising detecting the temperature of the regenerator, limiting the amount of heating in the regenerator for a first predetermined time after the temperature of the regenerator reaches a predetermined temperature, controlling the amount of heating in the regenerator in accordance with a load when the temperature of the regenerator after the passage of the first predetermined time is lower than the predetermined temperature, stopping the operation of the regenerator when the temperature of the regenerator reaches the predetermined temperature within a second predetermined time after the passage of the first predetermined time and continuing this suspension state.

The present invention claimed in claim 2 provides a method of controlling an absorption type refrigerating apparatus for controlling the amount of heating in a regenerator in accordance with a load by forming circulation paths for a refrigerant and an absorption solution by connecting the regenerator, a condenser, an evaporator and an absorber by pipes, the method comprising detecting the temperature of the regenerator, limiting the amount of heating in the regenerator for a first predetermined time after the temperature of the regenerator reaches a predetermined temperature, controlling the amount of heating in the regenerator in accordance with a load when the temperature of the regenerator after the passage of the first predetermined time is lower than the predetermined temperature, and abnormally suspending the regenerator when the temperature of the regenerator reaches the predetermined temperature within a second predetermined time after the passage of the first predetermined time to stop the operation of the absorption type refrigerating apparatus.

The present invention claimed in claim 3 provides a control apparatus for an absorption type refrigerating apparatus for controlling the amount of heating in a regenerator in accordance with a load by forming circulation paths for a refrigerant and an absorption solution by connecting the regenerator, a condenser, an evaporator and an absorber by pipes, the apparatus comprising a temperature detector for detecting the temperature of the regenerator and a controller which receives a signal from this temperature detector, stores a predetermined temperature, a first predetermined time and a second predetermined time longer than the first predetermined time, limits the amount of heating in the regenerator for the first predetermined time after the detection temperature of the temperature detector reaches the predetermined temperature, controls the amount of heating in the regenerator in accordance with a load when the detection temperature after the passage of the first predetermined time is lower than the predetermined temperature, outputs a regenerator operation stop signal when the detection temperature reaches the predetermined temperature within the second predetermined time after the passage of the first predetermined time and does not output an operation signal after the output of the stop signal.

The present invention claimed in claim 4 provides a method of controlling an absorption type refrigerating apparatus for controlling the amount of heating in a regenerator in accordance with a load by forming circulation paths for a refrigerant and an absorption solution by connecting the regenerator, a condenser, an evaporator and an absorber by pipes, the method comprising detecting the temperature of the regenerator, limiting the amount of heating in the regenerator for a first predetermined time after the temperature of the regenerator reaches a first predetermined temperature, controlling the amount of heating in the regenerator in accordance with a load when the temperature of the regenerator after the passage of the first predetermined time is lower than the first predetermined temperature, stopping the operation of the regenerator when the temperature of the regenerator reaches a second predetermined temperature higher than the first predetermined temperature within a second predetermined time after the passage of the first predetermined time and continuing this suspension state.

The present invention claimed in claim 5 provides a method of controlling an absorption type refrigerating apparatus for controlling the amount of heating in a regenerator in accordance with a load by forming circulation paths for a refrigerant and an absorption solution by connecting the regenerator, a condenser, an evaporator and an absorber by pipes, the method comprising detecting the temperature of the regenerator, limiting the amount of heating in the regenerator for a first predetermined time after the temperature of the regenerator reaches a first predetermined temperature, controlling the amount of heating in the regenerator in accordance with a load when the temperature of the regenerator after the passage of the first predetermined time is lower than the first predetermined temperature, and abnormally suspending the regenerator when the temperature of the regenerator reaches a second predetermined temperature higher than the first predetermined temperature within a second predetermined time after the passage of the first predetermined time to stop the operation of the absorption type refrigerating apparatus.

The present invention claimed in claim 6 provides a control apparatus for an absorption type refrigerating apparatus for controlling the amount of heating in a regenerator in accordance with a load by forming circulation paths for a refrigerant and an absorption solution by connecting the regenerator, a condenser, an evaporator and an absorber by pipes, the apparatus comprising a temperature detector for detecting the temperature of the regenerator and a controller which receives a signal from this temperature detector, stores a first predetermined temperature, a second predetermined temperature higher than the first predetermined temperature, a first predetermined time and a second predetermined time longer than the first predetermined time, limits the amount of heating in the regenerator for the first predetermined time after the detection temperature of the temperature detector reaches the first predetermined temperature, controls the amount of heating in the regenerator in accordance with a load when the detection temperature after the passage of the first predetermined time is lower than the first predetermined temperature, outputs a regenerator operation stop signal when the detection temperature reaches the second predetermined temperature within the second predetermined time after the passage of the first predetermined time and does not output an operation signal after the output of the stop signal.

BRIEF DESCRIPTION OF THE DRAWINGS

These and other objects and advantages of the present invention will become clear from the following description with reference to the accompanying drawings, wherein.

DETAILED DESCRIPTION OF THE PREFERRED EMBODIMENTS

Figure 1:
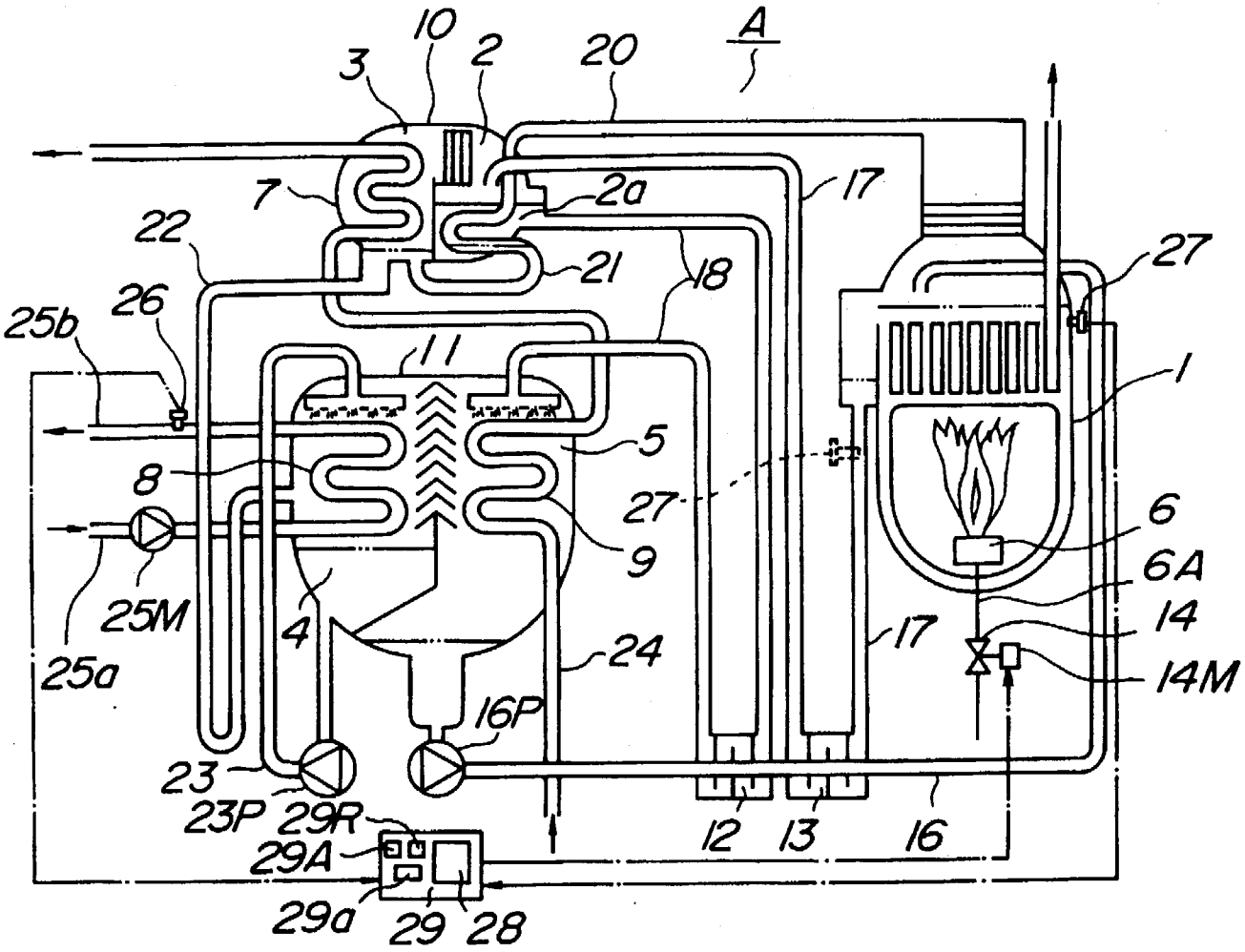
FIG. 1 is a circuit structural diagram of an absorption type refrigerating apparatus showing an embodiment claimed in claims 1 to 4 of the present invention.

A first embodiment of the present invention claimed in claims 1, 2 and 3 of the present invention is described in detail hereinunder with reference to the accompanying drawings.

Denoted at A in the figures is a single effect absorption type refrigerating apparatus which uses water (H2O), for example, as a refrigerant and a lithium bromide (LiBr) solution as an absorption solution (solution).

In the figures, reference numeral 1 is a high-temperature regenerator, 2 a low-temperature regenerator, 3 a condenser, 4 an evaporator, 5 an absorber, 6 a burner which is provided in the regenerator 1 as a heat source for burning gas as fuel, 7 a condenser heat exchanger, 8 an evaporator heat exchanger, 9 an absorber heat exchanger, 10 an upper barrel for housing the low-temperature regenerator 2 and the condenser 2, 11 a lower barrel for housing the evaporator 4 and the absorber 5, 12 a low-temperature heat exchanger and 13 a high-temperature heat exchanger. Reference symbol 6A is a fuel supply pipe connected to the gas burner 6, 14 a control valve provided along the fuel supply pipe and 14M a control valve drive motor.

Reference numeral 16 is a diluted absorption solution pipe extending from the absorber 5 to the high-temperature regenerator 1 and provided with an absorption solution pump 16P, the low-temperature heat exchanger 12 and the high-temperature heat exchanger 13 on the way, 17 an intermediate absorption solution pipe extending from the high-temperature regenerator 1 to the low-temperature regenerator 2 and provided with the high-temperature heat exchanger 13 on the way and 18 is a concentrated absorption solution pipe extending from the low-temperature regenerator 2 to the absorber 5 and provided with the low-temperature heat exchanger 12 on the way.

Reference numeral 20 is a refrigerant vapor pipe extending from the high-temperature regenerator 1 to the radiator **2*a* of the low-temperature regenerator 2, 21 a refrigerant pipe extending from the radiator 2*a* to the condenser 3, 22 a refrigerant downflow pipe extending from the condenser 3 to the evaporator 4, and 23 a refrigerant circulation pipe connected to the evaporator 4 and provided with a refrigerant pump 23*p*** on the way.

Reference numeral 24 is a cooling water pipe provided with the absorber heat exchanger 9 and the condenser heat exchanger 7 on the way. Denoted at **25*a* and 25*b* are cold water pipes, and at 25M a cold water pump provided with the evaporator heat exchanger 8** on the way.

Figure 2:
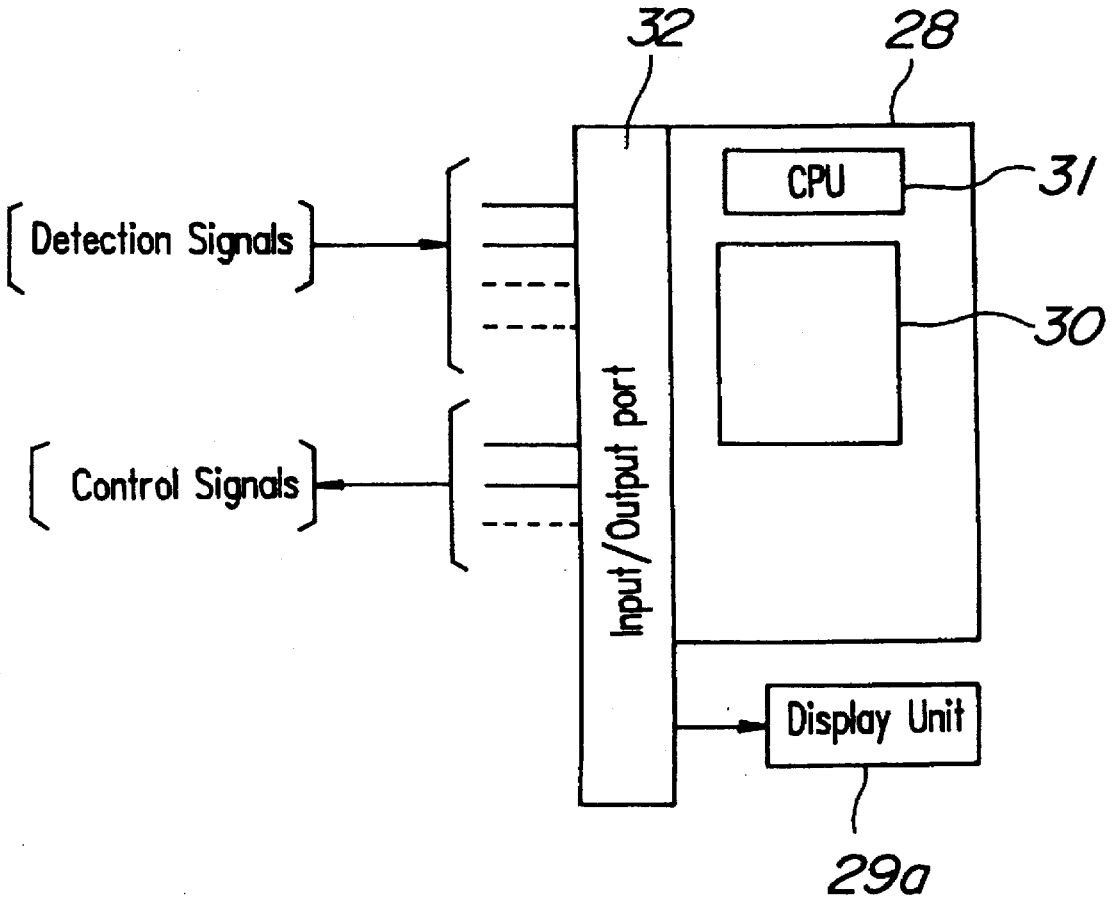
FIG. 2 is a schematic block diagram of a controller.

Reference numeral 26 is a first temperature detector, provided in the cold water pipe **25*b* on the exit side of the evaporator 4, for detecting the temperature of cold water to be supplied to an indoor heat exchanger (unshown) of a building or the like and 27 is a second temperature detector, provided in the high-temperature regenerator 1, for detecting the temperature of the absorption solution, for example, in the high-temperature regenerator 1. Reference numeral 28 is a controller composed of a microcomputer, for example, which is provided in a control board 29 of the absorption type refrigerating apparatus and comprises a storage element 30, a central processing unit (to be abbreviated as "CPU" hereinafter) 31, an input/output port 32 and the like as shown in FIG. 2. The storage element stores, for example, a first predetermined temperature (for example, 160iC) which is the temperature of the high-temperature regenerator 1 for forcedly reducing the amount of heating in the high-temperature regenerator 1, a first predetermined time (for example, 10 minutes) during which the amount of heating in the high-temperature regenerator 1 is forcedly reduced, a program for the proportional, derivative and integral control, for example, of the opening of the control valve 14 based on the detection temperature of the first temperature detector 26 and a program for controlling the opening of the control valve 14 based on comparison between the detection temperature of the second temperature detector 27** and the first predetermined temperature to forcedly stop the operation of the absorption type refrigerating apparatus (to be referred to as "abnormal suspension" hereinafter).

During the operation of the absorption type refrigerating apparatus A constituted as described above, like the time of the operation of the conventional absorption type refrigerating apparatus, gas is supplied to the burner 6 of the high-temperature regenerator 1 and the high-temperature regenerator 1 is activated. An absorption solution having a low concentration (to be referred to as "diluted absorption solution" hereinafter) is heated in the high-temperature regenerator 1 and a refrigerant is separated and evaporated from the diluted absorption solution. The evaporated refrigerant flows into the low-temperature regenerator 2 through the refrigerant vapor pipe 20. An intermediate absorption solution in the low-temperature regenerator 2 is heated by the refrigerant vapor from the high-temperature regenerator 1 and the refrigerant is further separated from the intermediate absorption solution. The refrigerant vapor from the high-temperature regenerator 1 is condensed in the low-temperature regenerator 2 and flows into the condenser 3 and the refrigerant separated in the low-temperature regenerator 2 also flows into the condenser 3, heat exchanges with cooling water running through the condenser heat exchanger 7 and is condensed and liquefied.

The liquefied refrigerant in the condenser 3 flows down to the evaporator 4 and is sprayed into the evaporator heat exchanger 8 by the operation of the refrigerant pump 23*p*. Then the refrigerant liquid heat exchanges with cold water running through the evaporator heat exchanger 8 and is evaporated and the cold water is cooled by heat of vaporization and supplied to a load such as an air conditioner or the like of a building. The refrigerant evaporated in the evaporator 4 flows into the absorber 5 and absorbed into a sprayed absorption solution having a high concentration (to be referred to as "concentrated solution" hereinafter).

The diluted absorption solution which has absorbed the refrigerant in the absorber 5 is elevated in temperature by the low-temperature heat exchanger 12 and the high-temperature heat exchanger 13 and supplied to the high-temperature regenerator 1. The diluted absorption solution is heated by the burner 6 in the high-temperature regenerator 1 to separate the refrigerant and become an intermediate absorption solution, and the intermediate absorption solution heat exchanges in the high-temperature heat exchanger 13 to be lowered in temperature and flows into the low-temperature regenerator 2. The refrigerant is further separated from the intermediate absorption solution in the low-temperature regenerator 2, whereby the intermediate absorption solution becomes a concentrated absorption solution having a higher concentration, is lowered in temperature in the low-temperature heat exchanger 12 and returns to the absorber 4.

When the absorption solution and the refrigerant circulate as described above, the opening of the control valve 14 is controlled based on the programs stored in the storage element 30 and the detection temperature of the first temperature detector 26. For instance, when the amount of a load increases and the exit temperature of cold water which is the detection temperature of the first temperature detector 26 rises, the controller 28 outputs an open signal to the control valve drive motor 14M, whereby the opening of the control valve 14 increases, the amount of heating of the burner 6 grows, and the amount of the refrigerant vapor separated from the diluted absorption solution increases. Therefore, the amount of the refrigerant liquid flown from the condenser 3 to the evaporator 4 grows, the capability of the evaporator 4 increases, and the exit temperature of cold water falls.

Further, for instance, when the exit temperature of cold water which is the detection temperature of the first temperature detector 26 falls, the controller 28 outputs a close signal to the control valve drive motor 14M, whereby the opening of the control valve 14 decreases, the amount of heating of the burner 6 reduces, and the amount of the refrigerant vapor separated from the diluted absorption solution lowers. Therefore, the amount of the refrigerant liquid flown from the condenser 3 to the evaporator 4 reduces, the capability of the evaporator 4 decreases, and the exit temperature of cold water rises.

As described above, the amount of heating in the high-temperature regenerator 1 is controlled and the cooling capability of the evaporator 4 is adjusted to maintain the exit temperature of cold water at a designated temperature, for example, 7iC.

Figure 3:
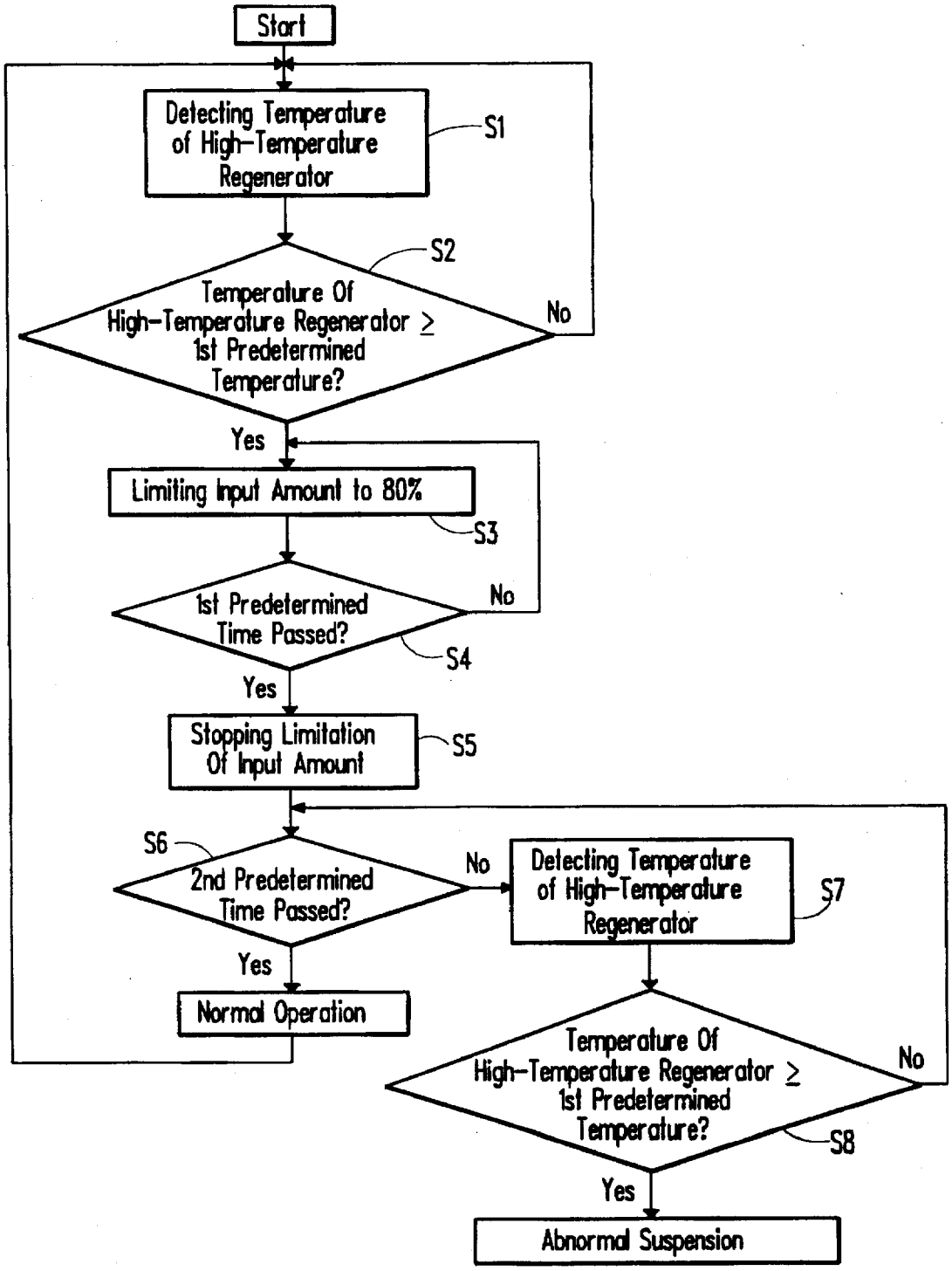
FIG. 3 is a flow chart for explaining the control of a control valve of the invention claimed in claims 1 and 2.

A description is subsequently given of control of the control valve 14, that is, control of the amount of heating in the high-temperature regenerator 1 based on the temperature of the high-temperature regenerator 1, that is, the detection temperature of the second temperature detector 27, when the opening of the control valve 14 of the absorption type refrigerating apparatus A with reference to the flow chart of FIG. 3 and the time chart of FIG. 4.

When the absorption type refrigerating apparatus operates as described above, in step 1 (S1) of the flow chart of FIG. 3, the second temperature detector detects the temperature of the absorption solution in the high-temperature regenerator 1 (to be referred to as "high-temperature regenerator temperature" hereinafter). In step 2 (S2), it is judged whether the detected high-temperature regenerator temperature is equal to or higher than a predetermined temperature. For example, when the high-temperature regenerator temperature becomes equal to or higher than the first predetermined temperature at a time T1 in FIG. 4, the processing returns to step 3 (S3) and the controller 28 forcedly limits the opening of the control valve 14 to 80% or less, for example, so that the amount of heating in the high-temperature regenerator 1 is limited to almost 80% or less. That is, even when the opening of the control valve 14 based on the exit temperature of cold water is more than 80%, the opening of the control valve 14 is limited to 80%.

Thereafter, it is judged whether the first predetermined time has passed in step 4 (S4). When the first predetermined time has not passed yet, the limitation of the opening of the control valve 14 is continued. When the first predetermined time has passed at a time T2 in FIG. 4, the controller 28 stops limiting the opening of the control valve 14 in step 5 (S5), the opening is opened up to the maximum of 100%, and the controller 28 returns to the normal control of the control valve based on the exit temperature of cold water.

The controller 28 counts time after the limitation of the opening of the control valve 14 is stopped at the time T2 and judges whether a second predetermined time has passed from the time T2 in step 6 (S6). When the second predetermined time has not passed yet, the second temperature detector 27 detects the high-temperature regenerator temperature in step 7 (S7) and judges whether the high-temperature regenerator temperature is equal to or higher than the first predetermined temperature in step 8 (S8).

When the high-temperature regenerator temperature is lower than the first predetermined temperature, the processing returns to step 6 from step 8 and when the second predetermined time has not passed yet, the processing returns to step 7 and step 8. Therefore, when the second predetermined time has not passed and the high-temperature regenerator temperature is lower temperature, the predetermined temperature, the controls of step 6, step 7 and step 8 are repeated sequentially.

When the second predetermined time has passed at a time T3 and it is judged in step 6 that the second time has passed while the controls of step 6, step 7 and step 8 are repeated sequentially as described above, normal control of the control valve is continued thereafter.

Figure 4:
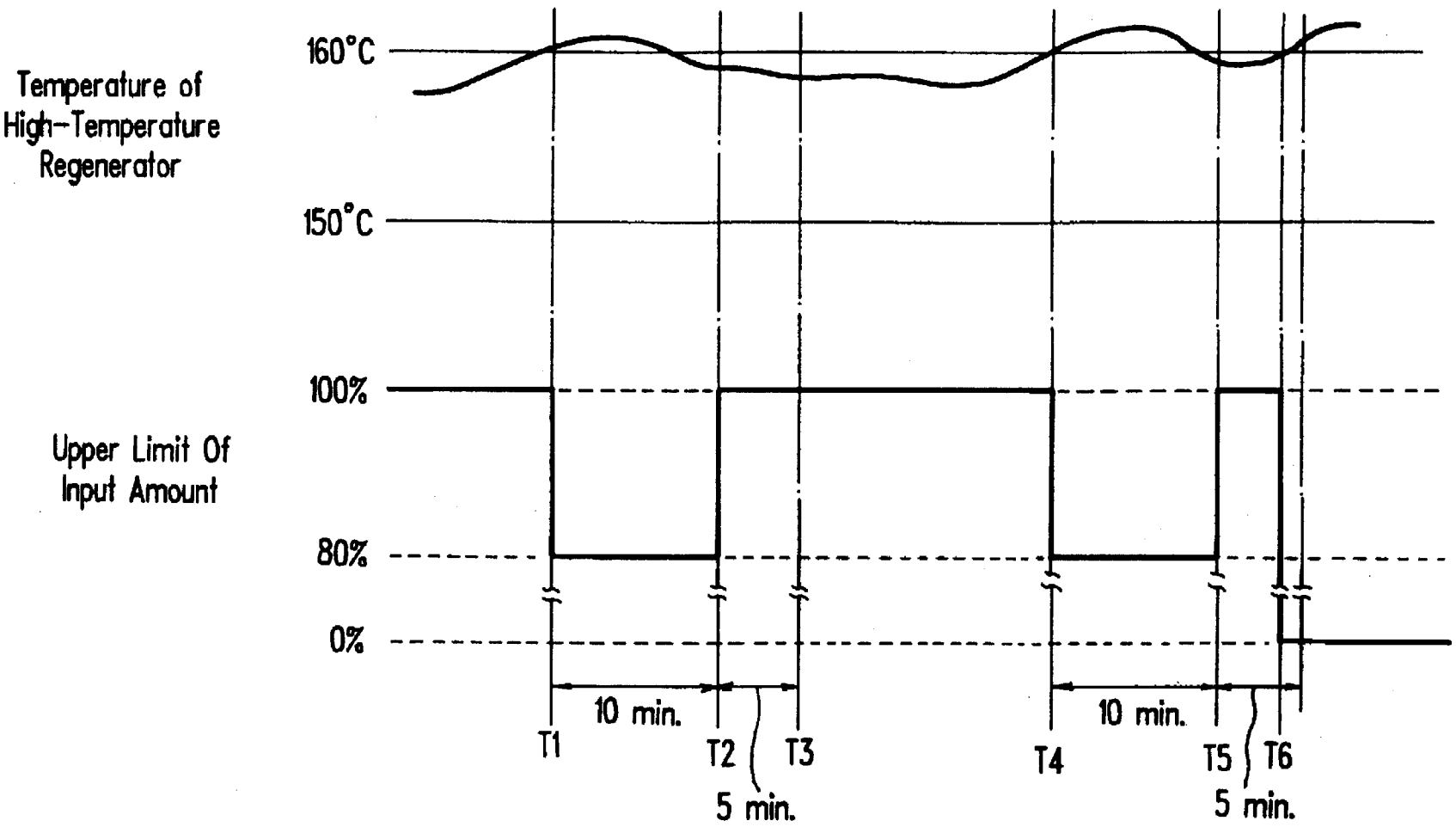
FIG. 4 is a time chart for explaining the control of the control valve of the invention claimed in claims 1 and 2.

When time has passed and the high-temperature regenerator temperature becomes equal to or higher than the first predetermined temperature again at a time T4 in FIG. 4, the controls of steps 2 to 4 are performed, whereby the opening of the control valve 14 is limited and the amount of heating in the high-temperature regenerator 1 is also limited. Thereafter, when time has passed and the first predetermined time has passed at a time T5, similarly as described above, the controller 28 stops limiting the opening of the control valve 14 in step 5, the opening is opened up to the maximum of 100%, and the controller 28 returns to normal control of the control valve based on the exit temperature of cold water.

The controller 28 counts time from the time T5 and judges weather the second predetermined time has passed from the time T5 in step 6. When the second predetermined time has not passed yet, the second temperature detector 27 detects the high-temperature regenerator temperature in step 7 and judges whether the high-temperature regenerator temperature is equal to or higher than the first predetermined temperature in step 8.

When the second predetermined time has not passed yet, the controller 28 repeats the controls of step 6, step 7 and step 8 sequentially and operates to control abnormal suspension when the it is judged that the high-temperature regenerator temperature is equal to or higher than the first predetermined temperature in step 8 at a time T6 before the second predetermined time passes.

Therefore, the controller 28 outputs a full close signal which is a stop signal to the control valve 14, whereby the control valve 14 is closed and heating in the high-temperature regenerator 1 stops with the result of the abnormal suspension of the high-temperature regenerator 1.

Even after the stoppage of heating in the high-temperature regenerator 1, like the conventional absorption type refrigerating apparatus, the absorption solution pump and the like operate for a predetermined time, the dilution operation of the absorption solution is performed, and then the absorption type refrigerating apparatus stops operation and is kept suspended.

The controller 28 outputs a signal to a display unit **29*a* such as a light emitting diode provided in a control board 29, and the display unit 29*a* lights up to display the abnormal suspension of the high-temperature regenerator 1** due to a rise in temperature. Therefore, the supervisor of the absorption type refrigerating apparatus can distinguish it from other abnormal suspension.

After the operation of the absorption type refrigerating apparatus A is stopped as described above, the supervisor performs inspection, repair work of a malfunctioning portion such as a leak portion, and operates a reset switch 29R provided in the control board, for example, after the repair work, to cancel the abnormal suspension state of the absorption type refrigerating apparatus A. By the operation of the operation switch 29A, the absorption type refrigerating apparatus A starts operation.

According to the first embodiment described above, the second temperature detector 27 detects of the high-temperature regenerator temperature, and the controller 28 limits the opening of the control valve 14 to a predetermined opening or less and the amount of heating in the high-temperature regenerator 1 for the first predetermined time when the high-temperature regenerator temperature becomes equal to or higher than the first predetermined temperature and then returns to the normal control of the opening of the control valve 14. When the high-temperature regenerator temperature becomes equal to or higher than the first predetermined temperature within the second predetermined time while the amount of heating in the high-temperature regenerator 1 is controlled based on the exit temperature of cold water, the controller 28 is activated to close the control valve 13, stop heating in the high-temperature regenerator 1 and stop the operation of the absorption type refrigerating apparatus. Therefore, a number of repetitions of operation and suspension of the high-temperature regenerator 1 caused by a rise in the temperature of the high-temperature regenerator 1 due to, for example, leakage of uncondensed gas in the absorption type refrigerating apparatus or a reduction in the capability of cooling water because of dirt can be avoided. Further, the high-temperature regenerator 1 can be prevented from repeating operation and suspension and from being kept at a high temperature, for example, around 160iC for a long period of time. As a result, the corrosion of the high-temperature regenerator 1 can be suppressed and inspection and maintenance work can be simplified.

Further, since the absorption type refrigerating apparatus A stops operation along with the suspension of the high-temperature regenerator 1, the operation of the absorption type refrigerating apparatus upon the occurrence of abnormality can be suppressed and operation costs can be reduced.

Figure 5:
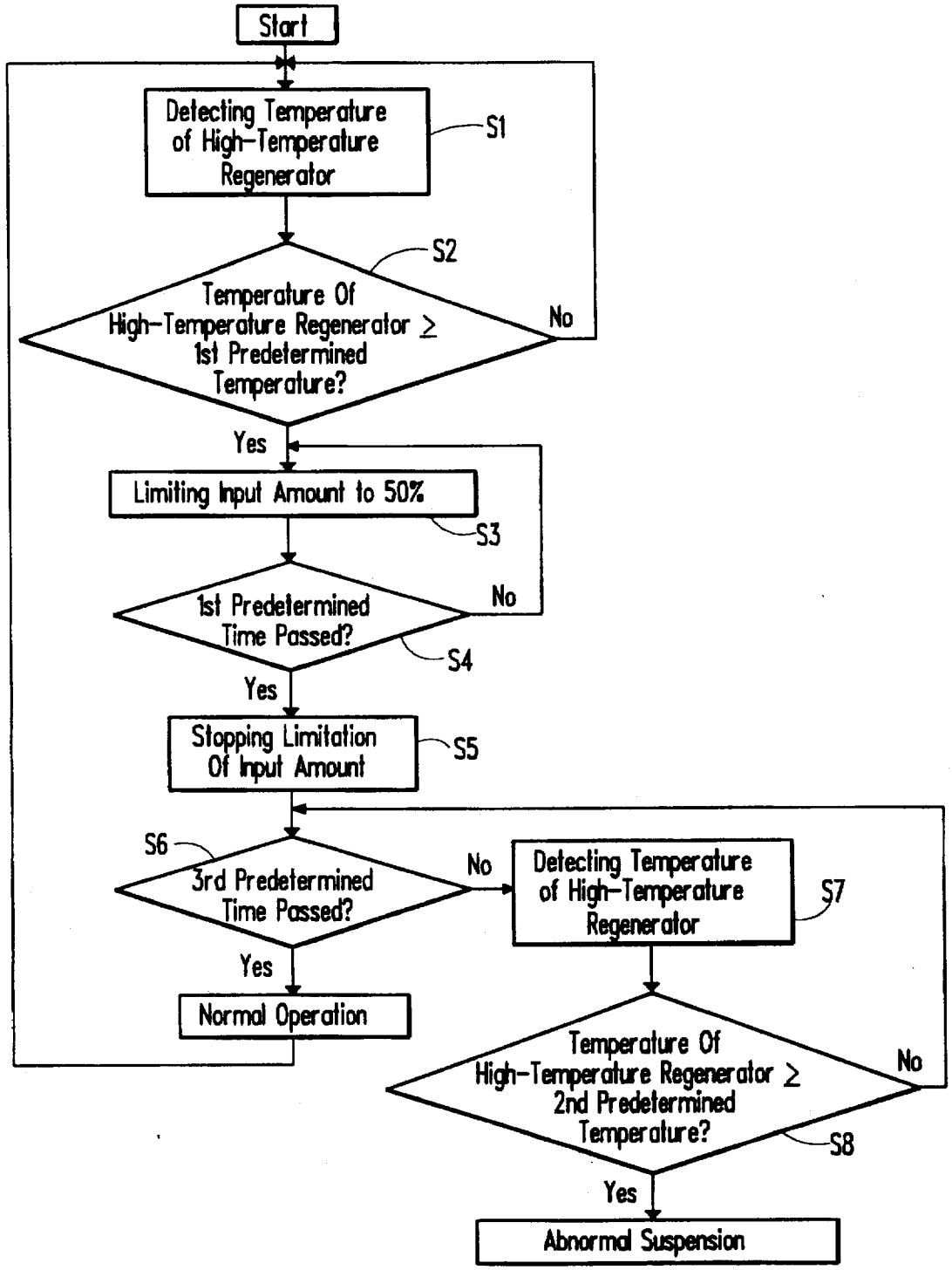
FIG. 5 is a flow chart for explaining the control of the control valve of the invention claimed in claims 3 and 4.
Figure 6:
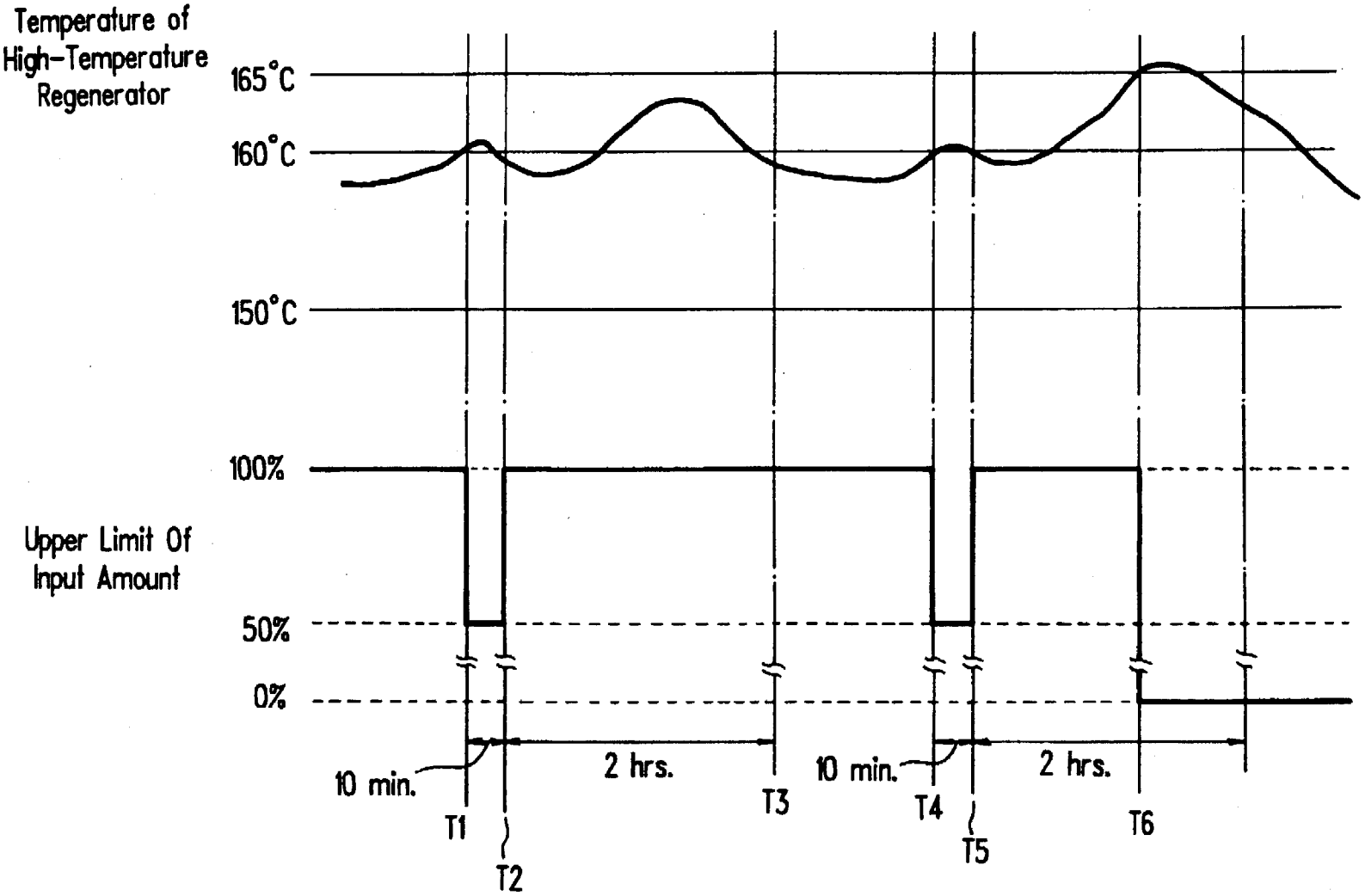
FIG. 6 is a time chart for explaining the control of the control valve of the invention claimed in claims 3 and 4.

A second embodiment of the present invention claimed in claims 4, 5 and 6 is described hereinunder with reference to the flow chart of FIG. 5 and the time chart of FIG. 6.

Since the constitutions of the absorption type refrigerating apparatus and the controller are the same as those of the absorption type refrigerating apparatus of FIG. 1 and the controller 28 of FIG. 2, their detailed descriptions are omitted and they are described with reference to FIGS. 1 and 2.

In the second embodiment, the storage device 30 of the controller 28 stores, for example, a first predetermined temperature (for example, 160iC) which is the temperature of the high-temperature regenerator 1 for forcedly limiting the opening of the control valve 14 to a predetermined opening (for example, 50%) or less independently of the exit temperature of cold water, that is, the amount of heating in the high-temperature regenerator 1, a second predetermined temperature set higher than the first predetermined temperature, a first predetermined time (for example, 10 minutes) for forcedly limiting the amount of heating in the high-temperature regenerator 1 to a predetermined opening or less, and a second predetermined time (for example, 2 hours) for abnormally suspending the absorption type refrigerating apparatus when the temperature of the high-temperature regenerator 1 reaches the second predetermined temperature within the second predetermined time through comparison between the temperature of the high-temperature regenerator 1 after the passage of the first predetermined time and the second predetermined temperature.

Further, the storage device 30 stores a program for controlling the opening of the control valve 14 to 100%, 50% or 0%, for example, based on the detection temperature of the first temperature detector 26, a third predetermined temperature (for example, 7.5iC), a fourth predetermined temperature (for example, 7.0iC) which is the designated exit temperature of cold water and a fifth predetermined temperature (for example, 6.5iC) so as to control the exit temperature of cold water to a constant temperature, that is, a program for the three-positional control of the control valve 14, a program for limiting the opening of the control valve 14 based on comparison between the detection temperature of the second temperature detector 27 and the second predetermined temperature and abnormally suspending the absorption type refrigerating apparatus, and the like.

During the operation of the absorption type refrigerating apparatus provided with the above controller 28, the absorption solution and the refrigerant circulate in the apparatus as described in the first embodiment. When the absorption solution and the refrigerant circulate, the opening of the control valve 14 is controlled based on the programs stored in the storage device 30 and the detection temperature of the first temperature detector 26. For instance, when the exit temperature of cold water which is the detection temperature of the first temperature detector 26 rises and exceeds the third designated temperature, for example, the controller 28 outputs an open signal to the control valve drive motor 14M, whereby the opening of the control valve 14 is increased to 100%, the amount of heating of the burner 6 grows, and the amount of the refrigerant vapor separated from the diluted absorption solution increases. Therefore, the amount of the refrigerant liquid flown from the condenser 3 to the evaporator 4 grows, the capability of the evaporator 4 increases, and the exit temperature of cold water falls.

For instance, when the exit temperature of cold water which is the detection temperature of the first temperature detector 26 falls to the fourth predetermined temperature, for example, the controller 28 outputs a close signal to the control valve drive motor 14M, whereby the opening of the control valve 14 is reduced to 50%, the amount of heating of the burner 6 decreases, and the amount of the refrigerant vapor separated from the diluted absorption solution drops. Therefore, the amount of the refrigerant liquid flown from the condenser 3 to the evaporator 4 reduces, the capability of the evaporator 4 lowers, and the exit temperature of cold water rises.

When the opening of the control valve 14 is controlled to 50%, for example, the detection temperature of the first temperature detector 26 falls to the fourth predetermined temperature, for example, due to a further reduction in the load, the controller 28 outputs a close signal (opening of 0%) to the control valve drive motor 14M, whereby the control valve 14 is closed, the burning of the burner 6 stops, and the amount of the refrigerant vapor separated from the diluted absorption solution drastically decreases. Therefore, the amount of the refrigerant liquid flown from the condenser 3 to the evaporator 4 further reduces, the capability of the evaporator 4 lowers, and the exit temperature of cold water rises.

Thereafter, when the detection temperature of the first temperature detector 26 rises to the fourth predetermined temperature, for example, the controller 28 outputs a 50% open signal to the control valve drive motor 14M. By this signal, the burner 6 is supplied with fuel and starts burning, the amount of the refrigerant vapor separated in the high-temperature regenerator 1 increases, and the cooling capability grows.

As described above, the opening of the control valve 14 is controlled based on the detection temperature of the first temperature detector 26, that is, the exit temperature of cold water, the amount of heating in the high-temperature regenerator 1 is adjusted, and the exit temperature of cold water is maintained at almost the fourth predetermined temperature which is the designated temperature.

The control of the control valve 14, that is, the control of the amount of heating in the high-temperature regenerator 1 based on the temperature of the high-temperature regenerator 1, that is, the detection temperature of the second temperature detector 27 when the opening of the control valve 14 of the absorption type refrigerating apparatus A is controlled is described with reference to the flow chart of FIG. 5 and the time chart of FIG. 6.

When the absorption type refrigerating apparatus operates as described above, like the above first embodiment, the second temperature detector 27 detects the high-temperature regenerator temperature in step 1 (S1) of the flow chart of FIG. 5. Then, it is judged whether the detected high-temperature regenerator temperature is equal to or higher than the first predetermined temperature in step 2 (S2). For instance, when the high-temperature regenerator temperature is equal to or higher than the first predetermined temperature at a time T1 in FIG. 6, the processing proceeds to step 3 (S3), and the controller 28 forcedly limits the opening of the control valve 14 to 50%, for example, and the amount of heating in the high-temperature regenerator 1 to almost 50% or less. That is, even when the opening of the control valve 14 is 100% based on the exit temperature of cold water, the opening of the control valve 14 is limited to 50%.

Thereafter, it is judged whether the first predetermined time has passed in step 4 (S4). When the first predetermined time has not passed yet, the limitation of the opening of the control valve 14 is continued. When the first predetermined time has passed at a time T2 in FIG. 6, the controller 28 stop limiting the opening of the control valve 14 in step 5 (S5) and the control valve 14 is opened to the maximum of 100%, and the controller 28 returns to normal control of the control valve based on the exit temperature of cold water.

The controller 28 counts time after the limitation of the opening of the control valve 14 is stopped at a time T2 and judges whether the third predetermined time longer than the first predetermined time has passed from the time T2 in step 6 (S6). When the third predetermined time has not passed yet, the second temperature detector 27 detects the high-temperature regenerator temperature in step 7 (S7) and judges whether the high-temperature regenerator temperature is equal to or higher than the second predetermined temperature higher than the first predetermined temperature in step 8 (S8).

When the high-temperature regenerator temperature is lower than the second predetermined temperature, the processing returns to step 6 from step 8, and when the third predetermined time has not passed yet, the processing proceeds to step 7 and step 8. Therefore, when the third predetermined time has not passed and the high-temperature regenerator temperature is lower than the second predetermined temperature, the controls of steps 6, step 7 and step 8 are repeated sequentially.

When the third predetermined time has passed in step 6 while the controls of step 6, step 7 and step 8 are repeated sequentially, normal control of the control valve is continued.

Thereafter, when time has passed and the high-temperature regenerator temperature becomes equal to or higher than the first predetermined temperature again at a time T4 in FIG. 6, the controls of steps 2 to 4 are performed and the opening of the control valve 14 and the amount of heating in the high-temperature regenerator 1 are limited. When time has passed and the first predetermined time has passed at a time T5, the controller 28 stop limiting the opening of the control valve 14 in step 5 as described above, the opening is opened to the maximum of 100%, and the controller 28 returns to normal control of the control valve based on the exit temperature of cold water.

The controller 28 counts time passed from the time T5 and judges whether the third predetermined time has passed from the time T5 in step 6. When the third predetermined time has not passed yet, the second temperature detector 27 detects the high-temperature regenerator temperature in step 7 and judges whether the high-temperature regenerator temperature is equal to or higher than the second predetermined temperature in step 8.

When the second predetermined time has not passed yet, the controller 28 repeats the controls of step 6, step 7 and step 8 sequentially, and when it is judged that the high-temperature regenerator temperature is equal to or higher than the second predetermined temperature at a time T6 before the third predetermined has passed in step 8, the controller 28 is activated to control abnormal suspension.

Therefore, the controller 28 outputs a full close signal which is a stop signal to the control valve 14, whereby the control valve 14 is closed and heating in the high-temperature regenerator 1 is stopped.

Even after heating in the high-temperature regenerator 1 is stopped, like the conventional absorption type refrigerating apparatus, the dilution operation of the absorption solution is performed and then the absorption type refrigerating apparatus A stops operation and is kept suspended.

The controller 28 outputs a signal to the display unit 29*a* such as a light emitting diode provided in the control board 29, and the display unit 19 lights up to display abnormal suspension due to a rise in the temperature of the high-temperature regenerator 1. Therefore, the supervisor of the absorption type refrigerating apparatus can distinguish it from other abnormal suspension.

After the operation of the absorption type refrigerating apparatus A is stopped as described above, like the above first embodiment, the supervisor performs inspection, repair work of a malfunctioning portion such as a leak portion, and operates a reset switch 29R provided in the control board, for example, after the repair work, to cancel the abnormal suspension state of the absorption type refrigerating apparatus A. By the operation of the operation switch 29A, the absorption type refrigerating apparatus A starts operation.

According to the above second embodiment, the second temperature detector 27 detects the high-temperature regenerator temperature, and the controller 28 limits the opening of the control valve 14 to a predetermined opening or less and the amount of heating in the high-temperature regenerator 1 for the first predetermined time when the high-temperature regenerator temperature becomes equal to or higher than the first predetermined temperature and then returns to the normal control of the opening of the control valve 14. Thereafter, when the high-temperature regenerator temperature becomes equal to or higher than the second predetermined temperature higher than the first predetermined temperature within the third predetermined time longer than the first predetermined time while the amount of heating in the high-temperature regenerator 1 is controlled based on the exit temperature of cold water, the controller 28 is activated to close the control valve 14 and stop heating in the high-temperature regenerator 1, thereby stopping the operation of the absorption type refrigerating apparatus. Therefore, a number of repetitions of operation and suspension of the high-temperature regenerator 1 caused by a rise in the temperature of the high-temperature regenerator 1 due to, for example, leakage of uncondensed gas in the absorption type refrigerating apparatus or a reduction in the capability of cooling water because of dirt can be avoided. Further, the high-temperature regenerator 1 can be prevented from repeating operation and suspension and from being kept at a high temperature, for example, around 160iC for a long period of time. As a result, the corrosion of the high-temperature regenerator 1 can be suppressed and maintenance work can be simplified.

Since the third predetermined time which is set after the first predetermined time is made longer than the first predetermined time and the high-temperature regenerator temperature for abnormally suspending the absorption type refrigerating apparatus within the third predetermined time is set at a temperature higher than the first predetermined temperature, a change in the high-temperature regenerator temperature caused by a sudden load change and a rise in the temperature of the high-temperature regenerator 1 caused by leakage of uncondensed gas in the absorption type refrigerating apparatus or a reduction in the capability of cooling water because of dirt can be more clearly distinguished from each other within the third predetermined time and hence, the absorption type refrigerating apparatus can be abnormally suspended more surely. Particularly when the amount of heating in the high-temperature regenerator 1 is controlled stepwise by three-positional control of the opening of the control valve 14, the absorption type refrigerating apparatus can be abnormally suspended as distinguished from variations in the high-temperature regenerator temperature caused by fluctuations in the amount of heating.

Since the absorption type refrigerating apparatus A stops operation along with the suspension of the high-temperature regenerator 1, the operation of the absorption type refrigerating apparatus upon the occurrence of abnormality can be suppressed and operation costs can be reduced.

It is to be distinctly understood that the invention is not limited to the above embodiments but may be otherwise variously embodied without departing from the spirit and scope of the invention.

For example, in the above embodiments, a double effect absorption type refrigerating apparatus has been illustrated in FIG. 1. Even when the present invention is applied to a single effect absorption type refrigerating apparatus and an absorption cooling and heating apparatus capable of supplying cold water or hot water, for example, the same function and effect as those of the above embodiments can be obtained.

In the above embodiments, the second temperature detector 27 is provided in the high-temperature regenerator 1 to directly detect the temperature of the high-temperature regenerator 1. The second temperature detector 27 may be provided along the intermediate absorption solution pipe 17 extending from the high-temperature regenerator 1 to the high-temperature heat exchanger as shown by a broken line in FIG. 1 so as to detect the temperature of the absorption solution running through the high-temperature heat exchanger from the high-temperature regenerator 1 directly or indirectly through the wall so that the control valve 14 is controlled based on the detected temperature as described in the above embodiments. In this case, the same function and effect as those of the above embodiments can be obtained.

In the above embodiments, the controller for controlling the amount of heating in the high-temperature regenerator 1 by PID (Proportional, Integral and Derivative) control or three-positional control of the control valve 14 has been explained to make it more understandable. Even when the control valve 14 is controlled by another control method such as a proportional control method based on the exit temperature of cold water, for example, the absorption type refrigerating apparatus is abnormally suspended by limiting the opening of the control valve 14 based on the high-temperature regenerator temperature as shown in the above embodiments. In this case, the same function and effect as those of the above embodiments can also be obtained.

The present invention provides a control method and control apparatus for an absorption type refrigerating apparatus as described above. According to the present invention claimed in claim 1, since the temperature of the regenerator is detected, the amount of heating in the regenerator is limited for the first predetermined time after the temperature of the regenerator reaches the predetermined temperature, the amount of heating in the regenerator is controlled in accordance with a load when the temperature of the regenerator after the passage of the first predetermined time is lower than the predetermined temperature, the operation of the regenerator is stopped when the temperature of the regenerator reaches the predetermined temperature within the second predetermined time after the passage of the first predetermined time, and this suspension state is continued, a number of repetitions of the operation and suspension of the regenerator caused by a rise in the temperature of the regenerator due to, for example, leakage of uncondensed gas in the absorption type refrigerating apparatus or a reduction in the capability of cooling water because of dirt can be avoided. Further, the high-temperature regenerator can be prevented from repeating operation and suspension and from being kept at a high temperature for a long period of time. As a result, the corrosion of the high-temperature regenerator can be suppressed and maintenance work can be simplified.

According to the present invention claimed in claim 2, since the temperature of the regenerator is detected, the amount of heating in the regenerator is limited for the first predetermined time after the temperature of the regenerator reaches the predetermined temperature, the amount of heating in the regenerator is controlled in accordance with a load when the temperature of the regenerator after the passage of the first predetermined time is lower than the predetermined temperature, the regenerator is abnormally suspended when the temperature of the regenerator reaches the predetermined temperature within the second predetermined time after the passage of the first predetermined time, and the operation of the absorption type refrigerating apparatus is stopped, a number of repetitions of the operation and suspension of the regenerator caused by a rise in the temperature of the regenerator due to, for example, leakage of uncondensed gas in the absorption type refrigerating apparatus or a reduction in the capability of cooling water because of dirt can be avoided. Further, the high-temperature regenerator can be prevented from repeating operation and suspension and from being kept at a high temperature for a long period of time. As a result, the corrosion of the high-temperature regenerator can be suppressed and maintenance work can be simplified. In addition, the operation of the absorption type refrigerating apparatus upon the occurrence of abnormality can be suppressed and operation costs can be reduced.

According to the present invention claimed in claim 3, since the controller receives a signal from the temperature detector for detecting the temperature of the regenerator, the storage device stores the predetermined temperature, the first predetermined time and the second predetermined time longer than the first predetermined time, the controller limits the amount of heating in the regenerator for the first predetermined time after the detection temperature of the temperature detector reaches the predetermined temperature, controls the amount of heating in the regenerator in accordance with a load when the detection temperature after the passage of the first predetermined time is lower than the predetermined temperature, outputs a regenerator operation stop signal when the detection temperature reaches the predetermined temperature within the second predetermined time after the passage of the first predetermined time and maintains its suspension state, when the temperature of the regenerator rises due to, for example, leakage of uncondensed gas in the absorption type refrigerating apparatus or a reduction in the capability of cooling water because of dirt, the controller is activated to forcedly stop the regenerator abnormally, thereby making it possible to avoid a number of repetitions of operation and suspension of the regenerator. Further, the regenerator can be prevented from repeating operation and suspension and from being maintained at a high temperature for a long period of time. As a result, the corrosion of the regenerator can be suppressed and maintenance work can be simplified.

According to the present invention claimed in claim 4, since the temperature of the regenerator is detected, the amount of heating in the regenerator is limited for the first predetermined time after the temperature of the regenerator reaches the first predetermined temperature, the amount of heating in the regenerator is controlled in accordance with a load when the temperature of the regenerator after the passage of the first predetermined time is lower than the first predetermined temperature, the operation of the regenerator is stopped when the temperature of the regenerator reaches the second predetermined temperature higher than the first predetermined temperature within the second predetermined time after the passage of the first predetermined time, and this suspension state is continued, a number of repetitions of the operation and suspension of the regenerator caused by a rise in the temperature of the regenerator due to, for example, leakage of uncondensed gas in the absorption type refrigerating apparatus or a reduction in the capability of cooling water because of dirt can be avoided. Further, the high-temperature regenerator can be prevented from repeating operation and suspension and from being kept at a high temperature, for example, around 160iC for a long period of time. As a result, the corrosion of the high-temperature regenerator can be suppressed and maintenance work can be simplified.

According to the present invention claimed in claim 5, since the temperature of the regenerator is detected, the amount of heating in the regenerator is limited for the first predetermined time after the temperature of the regenerator reaches the first predetermined temperature, the amount of heating in the regenerator is controlled in accordance with a load when the temperature of the regenerator after the passage of the first predetermined time is lower than the first predetermined temperature, the regenerator is abnormally suspended when the temperature of the regenerator reaches the second predetermined temperature higher than the first predetermined temperature within the second predetermined time after the passage of the first predetermined time, and the operation of the absorption type refrigerating apparatus is stopped, a number of repetitions of the operation and suspension of the regenerator caused by a rise in the temperature of the regenerator due to, for example, leakage of uncondensed gas in the absorption type refrigerating apparatus or a reduction in the capability of cooling water because of dirt can be avoided. Further, the high-temperature regenerator can be prevented from repeating operation and suspension and from being kept at a high temperature, for example, around 160iC for a long period of time. As a result, the corrosion of the high-temperature regenerator can be suppressed and maintenance work can be simplified. In addition, the operation of the absorption type refrigerating apparatus upon the occurrence of abnormality can be suppressed and operation costs can be reduced.

Since the third predetermined time which is set after the first predetermined time is made longer than the first predetermined time and the temperature of the regenerator for abnormally suspending the absorption type refrigerating apparatus within the third predetermined time is set higher than the first predetermined temperature, a change in the regenerator temperature caused by a sudden load change and a rise in the regenerator temperature caused by leakage of uncondensed gas in the absorption type refrigerating apparatus or a reduction in the capability of cooling water because of dirt can be more clearly distinguished from each other within the third predetermined time and hence, the absorption type refrigerating apparatus can be abnormally suspended more surely.

Further, according to the present invention claimed in claim 6, since the controller receives a signal from the temperature detector for detecting the temperature of the regenerator, stores the first predetermined temperature, the second predetermined temperature higher than the first predetermined temperature, the first predetermined time and the second predetermined time longer than the first predetermined time, limits the amount of heating in the regenerator for the first predetermined time after the detection temperature of the temperature detector reaches the first predetermined temperature, controls the amount of heating in the regenerator in accordance with a load when the detection temperature after the passage of the first predetermined time is lower than the first predetermined temperature, outputs a regenerator operation stop signal when the detection temperature reaches the second predetermined temperature within the second predetermined time after the passage of the first predetermined time and maintains its suspension state, a number of repetitions of operation and suspension of the regenerator caused by a rise in the temperature of the regenerator due to, for example, leakage of uncondensed gas in the absorption type refrigerating apparatus or a reduction in the capability of cooling water because of dirt can be avoided. Further, the regenerator can be prevented from repeating operation and suspension and from being maintained at a high temperature, for example, around 160iC for a long period of time. As a result, the corrosion of the regenerator can be suppressed and maintenance work can be simplified.

Since the third predetermined time which is set after the first predetermined time is made longer than the first predetermined time and the temperature of the regenerator for abnormally suspending the absorption type refrigerating apparatus within the third predetermined time is set higher than the first predetermined temperature, a change in the regenerator temperature caused by a sudden load change and a rise in the regenerator temperature caused by leakage of uncondensed gas in the absorption type refrigerating apparatus or a reduction in the capability of cooling water because of dirt can be more clearly distinguished from each other within the third predetermined time and hence, the absorption type refrigerating apparatus can be abnormally suspended more surely.

What is claimed is:

1. A method of controlling an absorption type refrigerating apparatus for controlling the amount of heating in a regenerator in accordance with a load by forming circulation paths for a refrigerant and an absorption solution by connecting the regenerator, a condenser, an evaporator and an absorber by pipes, the method comprising detecting the temperature of the regenerator, limiting the amount of heating in the regenerator for a first predetermined time after the temperature of the regenerator reaches a predetermined temperature, controlling the amount of heating in the regenerator in accordance with a load when the temperature of the regenerator after the passage of the first predetermined time is lower than the predetermined temperature, stopping the operation of the regenerator when the temperature of the regenerator reaches the predetermined temperature within a second predetermined time after the passage of the first predetermined time and continuing this suspension state.

2. A method of controlling an absorption type refrigerating apparatus for controlling the amount of heating in a regenerator in accordance with a load by forming circulation paths for a refrigerant and an absorption solution by connecting the regenerator, a condenser, an evaporator and an absorber by pipes, the method comprising detecting the temperature of the regenerator, limiting the amount of heating in the regenerator for a first predetermined time after the temperature of the regenerator reaches a predetermined temperature, controlling the amount of heating in the regenerator in accordance with a load when the temperature of the regenerator after the passage of the first predetermined time is lower than the predetermined temperature, and abnormally suspending the regenerator when the temperature of the regenerator reaches the predetermined temperature within a second predetermined time after the passage of the first predetermined time to stop the operation of the absorption type refrigerating apparatus.

3. A control apparatus for an absorption type refrigerating apparatus for controlling the amount of heating in a regenerator in accordance with a load by forming circulation paths for a refrigerant and an absorption solution by connecting the regenerator, a condenser, an evaporator and an absorber by pipes, the apparatus comprising a temperature detector for detecting the temperature of the regenerator and a controller which receives a signal from this temperature detector, stores a predetermined temperature, a first predetermined time and a second predetermined time longer than the first predetermined time, limits the amount of heating in the regenerator for the first predetermined time after the detection temperature of the temperature detector reaches the predetermined temperature, controls the amount of heating in the regenerator in accordance with a load when the detection temperature after the passage of the first predetermined time is lower than the predetermined temperature, outputs a regenerator operation stop signal when the detection temperature reaches the predetermined temperature within the second predetermined time after the passage of the first predetermined time and does not output an operation signal after the output of the stop signal.

4. A method of controlling an absorption type refrigerating apparatus for controlling the amount of heating in a regenerator in accordance with a load by forming circulation paths for a refrigerant and an absorption solution by connecting the regenerator, a condenser, an evaporator and an absorber by pipes, the method comprising detecting the temperature of the regenerator, limiting the amount of heating in the regenerator for a first predetermined time after the temperature of the regenerator reaches a first predetermined temperature, controlling the amount of heating in the regenerator in accordance with a load when the temperature of the regenerator after the passage of the first predetermined time is lower than the first predetermined temperature, stopping the operation of the regenerator when the temperature of the regenerator reaches a second predetermined temperature higher than the first predetermined temperature within a second predetermined time after the passage of the first predetermined time and continuing this suspension state.

5. A method of controlling an absorption type refrigerating apparatus for controlling the amount of heating in a regenerator in accordance with a load by forming circulation paths for a refrigerant and an absorption solution by connecting the regenerator, a condenser, an evaporator and an absorber by pipes, the method comprising detecting the temperature of the regenerator, limiting the amount of heating in the regenerator for a first predetermined time after the temperature of the regenerator reaches a first predetermined temperature, controlling the amount of heating in the regenerator in accordance with a load when the temperature of the regenerator after the passage of the first predetermined time is lower than the first predetermined temperature, abnormally suspending the regenerator when the temperature of the regenerator reaches a second predetermined temperature higher than the first predetermined temperature within a second predetermined time after the passage of the first predetermined time to stop the operation of the absorption type refrigerating apparatus and continuing this suspension state.

6. A control apparatus for an absorption type refrigerating apparatus for controlling the amount of heating in a regenerator in accordance with a load by forming circulation paths for a refrigerant and an absorption solution by connecting the regenerator, a condenser, an evaporator and an absorber by pipes, the apparatus comprising a temperature detector for detecting the temperature of the regenerator and a controller which receives a signal from this temperature detector, stores a first predetermined temperature, a second predetermined temperature higher than the first predetermined temperature, a first predetermined time and a second predetermined time longer than the first predetermined time, limits the amount of heating in the regenerator for the first predetermined time after the detection temperature of the temperature detector reaches the first predetermined temperature, controls the amount of heating in the regenerator in accordance with a load when the detection temperature after the passage of the first predetermined time is lower than the first predetermined temperature, outputs a regenerator operation stop signal when the detection temperature reaches the second predetermined temperature within the second predetermined time after the passage of the first predetermined time and does not output an operation signal after the output of the stop signal.

* * * * *